US011152678B2

(12) United States Patent
Yoshimoto et al.

(10) Patent No.: US 11,152,678 B2
(45) Date of Patent: Oct. 19, 2021

(54) CONNECTOR-ATTACHED DIELECTRIC WAVEGUIDE INCLUDING A CONNECTING PORTION AND A FIXING PORTION THAT ARE SLIDABLY AXIALLY MOVABLE WITH RESPECT TO EACH OTHER

(71) Applicants: DAIKIN INDUSTRIES, LTD., Osaka (JP); NATIONAL INSTITUTE OF ADVANCED INDUSTRIAL SCIENCE AND TECHNOLOGY, Tokyo (JP)

(72) Inventors: Hiroyuki Yoshimoto, Osaka (JP); Dai Fukami, Osaka (JP); Taku Yamanaka, Osaka (JP); Tomohiro Ikeda, Osaka (JP); Masahiro Horibe, Tsukuba (JP); Yuto Kato, Tsukuba (JP)

(73) Assignees: DAIKIN INDUSTRIES, LTD., Osaka (JP); NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 0 days.

(21) Appl. No.: 16/610,108

(22) PCT Filed: May 18, 2018

(86) PCT No.: PCT/JP2018/019397
§ 371 (c)(1),
(2) Date: Nov. 1, 2019

(87) PCT Pub. No.: WO2018/216636
PCT Pub. Date: Nov. 29, 2018

(65) Prior Publication Data

US 2020/0083578 A1 Mar. 12, 2020

(30) Foreign Application Priority Data

May 24, 2017 (JP) ..... JP2017-102966

(51) Int. Cl.
*H01P 5/08* (2006.01)
*H01P 1/04* (2006.01)
(Continued)

(52) U.S. Cl.
CPC ..... *H01P 5/087* (2013.01); *H01P 1/04* (2013.01); *H01P 1/042* (2013.01); *H01P 1/18* (2013.01); *H01P 3/16* (2013.01)

(58) Field of Classification Search
CPC ..... H01P 3/16; H01P 1/042; H01P 5/087
(Continued)

(56) References Cited

U.S. PATENT DOCUMENTS 4,603,942 A * 8/1986 Chang et al. ..... G02B 6/4415 333/241
5,148,593 A 9/1992 Walter
(Continued)

FOREIGN PATENT DOCUMENTS

JP 02-199903 A 8/1990
JP 04-32304 A 2/1992
(Continued)

OTHER PUBLICATIONS

International Search Report of PCT/JP2018/019397 dated Jul. 17, 2018.
(Continued)

*Primary Examiner* — Benny T Lee
(74) *Attorney, Agent, or Firm* — Sughrue Mion, PLLC

(57) ABSTRACT

The invention provides a connector-attached dielectric waveguide that allows the dielectric waveguide to be easily connectable with an opposite component and is capable of forming a connection structure exhibiting low transmission and return losses of a high frequency signal. The connector-attached dielectric waveguide includes a dielectric waveguide and a connector. The dielectric waveguide includes a
(Continued)

dielectric waveguide body and a dielectric waveguide end. The dielectric waveguide end has a smaller cross-sectional area than the dielectric waveguide body.

4 Claims, 2 Drawing Sheets

(51) Int. Cl.
*H01P 1/18* (2006.01)
*H01P 3/16* (2006.01)

(58) Field of Classification Search
USPC ..... 333/254, 248
See application file for complete search history.

(56) References Cited

U.S. PATENT DOCUMENTS

| | | | | |
|---|---|---|---|---|
| 9,350,063 | B2 * | 5/2016 | Herbsommer et al. | H05K 1/024 |
| 2016/0308266 | A1 * | 10/2016 | Hammerschmidt | H01Q 1/50 |

FOREIGN PATENT DOCUMENTS

| | | | |
|---|---|---|---|
| JP | 05-313035 | A | 11/1993 |
| JP | 10-123072 | A | 5/1998 |
| JP | 2003-209412 | A | 7/2003 |
| JP | 2012-222438 | A | 11/2012 |

OTHER PUBLICATIONS

International Preliminary Report on Patentability and Written Opinion issued from the International Bureau in International Application No. PCT/JP2018/019397, dated Nov. 26, 2019.

Extended European Search Report dated Nov. 17, 2020 in counterpart European Application No. 18805689.9.

Hofmann et al., "Flexible Low-Loss Dielectric Waveguides for THz Frequencies with Transitions to Metal Waveguides", 33rd European Microwave Conference, Oct. 1, 2003, pp. 955-958 (4 pages total), XP0331069879.

Richter et al., "Mean and Differential Phase Centers of Rectangular Dielectric Rod Antennas", 34th European Microwave Conference, Oct. 11, 2004, vol. 3, pp. 1193-1196 (4 pages total), XP010788308.

* cited by examiner

CONNECTOR-ATTACHED DIELECTRIC WAVEGUIDE INCLUDING A CONNECTING PORTION AND A FIXING PORTION THAT ARE SLIDABLY AXIALLY MOVABLE WITH RESPECT TO EACH OTHER

CROSS REFERENCE TO RELATED APPLICATIONS

This application is a National Stage of International Application No. PCT/JP2018/019397 filed May 18, 2018, claiming priority based on Japanese Patent Application No. 2017-102966 filed May 24, 2017.

TECHNICAL FIELD

The invention relates to connector-attached dielectric waveguides.

BACKGROUND ART

Dielectric waveguides, waveguides, coaxial cables, and similar devices are used to transmit high frequency signals such as microwaves and millimeter waves. In particular, dielectric waveguides and waveguides are used as transmission lines for high frequency band electromagnetic waves such as millimeter waves. A common dielectric waveguide is composed of an inner layer and an outer layer and the dielectric waveguide utilizes the difference in permittivity between the layers to transmit electromagnetic waves by side reflection. The outer layer may be the air. Still, in order to stabilize the permittivity and to achieve easy handling, the outer layer is usually a soft structure having a low tan δ and a low permittivity made of, for example, resin foam. In practical implementation, transmission lines of different kinds are often coupled with each other. A dielectric waveguide may be coupled with a waveguide or a coaxial cable, or coaxial cables of different shapes may be coupled with each other. In order to reduce the return loss at a connection point of these different transmission lines, the impedances or modes of the transmission lines are to be matched to each other. Such matching of impedances or modes and conversion thereof for the matching are achieved using a special transformer or using a special structure. A rapid change in impedance may cause reflection of high frequency signals, resulting in loss of transmission efficiency.

Patent Literature 1 discloses a resonator with a dielectric waveguide. This resonator has a structure in which one or two dielectric waveguides are inserted in one or two holes made in a reflector of a Fabry-Perot resonator, wherein a tip of the dielectric waveguide inserted to adhere to a resonating portion through the hole of the reflector is tapered with a conical shape, for example.

Patent Literature 2 discloses a coaxial waveguide transformer for connecting a circular coaxial line and a rectangular coaxial line. The coaxial waveguide transformer includes a ridge waveguide whose inner and outer conductors are integrated, and the inner conductor is changed in a stepwise or tapering manner in the longitudinal direction.

Patent Literature 3 discloses a non-radiative dielectric line including dielectric lines between conductor plates. The dielectric lines include at least a dielectric line (line 1) made of a material having a prescribed permittivity and a dielectric line (line 2) made of a material having a lower permittivity than the material of the line 1.

Non-Patent Literature 1 discloses preparation of a polyethylene waveguide that has a circular cross section and is provided with a conical horn at each end, and measurement of the $HE_{11}$ mode transmission loss thereof.

Patent Literature 4 discloses a method for making a joint between two sections of a dielectric waveguide. The method includes: cutting one end of one of the dielectric sections to be jointed in a precise transverse cut perpendicular to the long axis of the waveguide; joining together a flanged coupling and an aluminum alignment tool; stripping away from the dielectric waveguide at the one end thereof a portion of a cladding and shielding layers to expose a length of a core; and precisely radially aligning the corresponding cross-sections of the core and the opening in the alignment tool with respect to each other.

CITATION LIST

Patent Literature

Patent Literature 1: JP H10-123072 A (1998)

Patent Literature 2: JP 2012-222438 A (2012)

Patent Literature 3: JP 2003-209412 A (2003)

Patent Literature 4: JP H05-313035 A (1993)

Non-Patent Literature

Non-Patent Literature 1: Shuichi SHINDO and Isao OTOMO, "100 GHz-tai dojiku-gata yudentai senro" (100 GHz band coaxial dielectric waveguide), IECE Technical Report, 1975, Vol. 75, No. 189, p, 75-80

SUMMARY OF THE INVENTION

Technical Problem

The invention aims to provide a connector-attached dielectric waveguide that allows the dielectric waveguide to be easily connectable with an opposite component and is capable of forming a connection structure exhibiting low transmission and return losses of a high frequency signal.

Solution to the Problem

In response to the above issue, the connector-attached dielectric waveguide of the invention includes a dielectric waveguide and a connector, the dielectric waveguide including a dielectric waveguide body and a dielectric waveguide end, the dielectric waveguide end having a smaller cross-sectional area than the dielectric waveguide body.

Advantageous Effects of the Invention

The connector-attached dielectric waveguide of the invention allows the dielectric waveguide to be easily connectable with an opposite component such as a hollow metallic tube and can be connected with an opposite component to form a connection structure exhibiting low transmission and return losses of a high frequency signal.

DETAILED DESCRIPTION OF THE PREFERRED EMBODIMENTS

The connector-attached dielectric waveguide of the invention is described with reference to the drawings where like features are denoted by the same reference numbers throughout the drawings.

Figure 1:
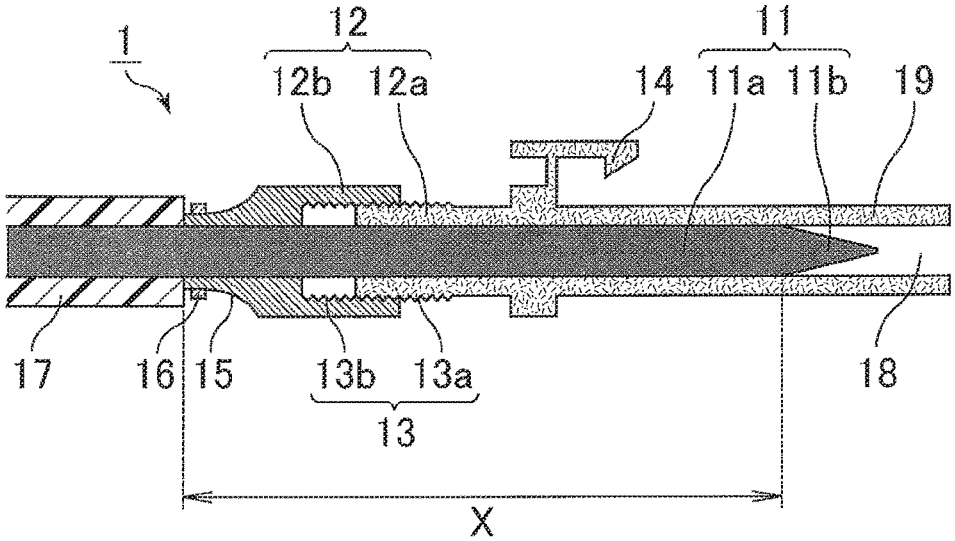
FIG. 1 is a cross-sectional view of an exemplary connector-attached dielectric waveguide of the invention.

A connector-attached dielectric waveguide 1 illustrated in FIG. 1 includes a dielectric waveguide 11 and a connector 12. The dielectric waveguide 11 includes a dielectric waveguide body 11*a* and a dielectric waveguide end 11*b*. The dielectric waveguide 11 is covered with an outer layer 17, except for the portion provided with the connector 12.

The of the connector 12 allows the connector-attached dielectric waveguide 1 to be easily detachable from an opposite component (not illustrated).

The dielectric waveguide end 11*b* of the connector-attached dielectric waveguide 1 has a smaller cross-sectional area than the dielectric waveguide body 11*a*. Thus, when connected with a hollow metallic tube that serves as an opposite component (not illustrated), the connector-attached dielectric waveguide 1 can reduce a rapid change in impedance between the dielectric waveguide and the hollow metallic tube, leading to a connection structure exhibiting low transmission and return losses.

The dielectric waveguide end 11*b* may have a shape of cone, truncated cone, pyramid, or truncated pyramid. A conical shape is easy to produce.

The cross-sectional area of the dielectric waveguide body 11*a* is preferably 0.008 $mm^2$ (ϕ0.1 mm, 1.8 THz) or larger and 18000 $mm^2$ (ϕ150 mm, 600 MHz) or smaller, more preferably 0.28 $mm^2$ (ϕ0.6 mm, 300 GHz) or larger and 64 $mm^2$ (ϕ9 mm, 20 GHz) or smaller, where "ϕ" signifies "diameter".

In order to achieve high transmission efficiency, the cross-sectional area of the dielectric waveguide end 11*b* is preferably 1% or more, more preferably 5% or more, still more preferably 10% or more of the cross-sectional area of the dielectric waveguide body 11*a*. The cross-sectional area of the dielectric waveguide end 11*b* is also preferably 90% or less, more preferably 80% or less, still more preferably 70% or less of the cross-sectional area of the dielectric waveguide body 11*a*.

In order to reduce a rapid change in permittivity, the cross-sectional area of the dielectric waveguide end 11*b* may also preferably decrease gradually or stepwise toward the tip. The reduction rate in cross-sectional area of the dielectric waveguide end 11*b* toward the tip per 1 mm is preferably 0.1% or higher, more preferably 0.5% or higher, still more preferably 1% or higher. The reduction rate in cross-sectional area of the dielectric waveguide end 11*b* toward the tip per 1 mm is also preferably 30% or lower, more preferably 20% or lower, still more preferably 10% or lower.

The connector 12 of the connector-attached dielectric waveguide 1 includes a connecting portion 12*a* and a fixing portion 12*b*. The connecting portion 12*a* is connectable with an opposite component and can slidably hold the dielectric waveguide body 11*a*. The fixing portion 12*b* is axially movably connected with the connecting portion 12*a*. The fixing portion 12*b* is fixed to the dielectric waveguide body 11*a*.

Phase control is important to communication systems such as mobile phones. For transmission lines, the difference in phase between an inlet and an outlet may be adjusted. This may be achieved by the use of a phase adjustor or a phase shifter that changes the physical length or electrical length to adjust the phases.

In the connector-attached dielectric waveguide 1, the connecting portion 12*a* of the connector 12 is axially movably connected with the fixing portion 12*b*. The axial movement of these portions enables precise adjustment of the axial position of the dielectric waveguide end 11*b* relative to the connecting portion 12*a*, which then enables precise adjustment of the phase. For example, the phase of a 30-GHz millimeter wave can be adjusted by adjusting the axial position of the dielectric waveguide end 11*b* within the range of ±5 mm. This can therefore eliminate the need for the use of a phase adjuster or a phase shifter for phase adjustment.

The connecting portion 12*a* includes at a first end an axially extending hollow protrusion 19 and at a second end an external thread 13*a* connectable with the fixing portion 12*b* and a radially protruding locking portion 14. The connecting portion 12*a* includes a fitting hole 18 into which the dielectric waveguide body 11*a* is fit. The connecting portion 12*a* slidably holds the dielectric waveguide 11*a*. In other words, the connecting portion 12*a* is axially movable relative to the dielectric waveguide 11 and the connecting portion 12*a* is rotatable in the circumferential direction of the dielectric waveguide 11.

The fixing portion 12*b* includes at a first end an internal thread 13*b* that engages with the external thread 13*a* to form axially movable connection with the connecting portion 12*a*. The fixing portion 12*b* includes the fitting hole 18 into which the dielectric waveguide body 11*a* is fit. The fixing portion 12*b* includes at a second end a tapered surface 15 whose outer diameter decreases toward the second end. The tapered surface 15 includes a clamp 16 that is pressed in the direction of the internal thread 13*b* to press the inner surface of the fitting hole 18 in the direction of reducing the diameter of the hole. This fixes the fixing portion 12*b* to the dielectric waveguide body 11*a*, restricting the movement of the fixing portion 12*b*.

In order to precisely adjust the axial position of the dielectric waveguide end 11*b*, the connector 12 may include a phase adjustment threaded fastener 13 that axially movably connects the fixing portion 12*b* to the connecting portion 12*a*. In the case of the connector-attached dielectric waveguide 1 illustrated in FIG. 1, the external thread 13*a* is cut on the connecting portion 12*a* and the internal thread 13*b* is cut on the fixing portion 12*b*. The external thread 13*a* and the internal thread 13*b* together constitute the phase adjustment threaded fastener 13. The external thread and the internal thread may be cut in a converse manner to the structure illustrated in FIG. 1.

With the phase adjustment threaded fastener 13, the fixing portion 12*b* is fixed to the dielectric waveguide body 11*a*. In this case, the axial position of the dielectric waveguide end 11*b* relative to the connecting portion 12*a* can be adjusted by rotating the connecting portion 12*a*, so that the phase can be adjusted. An additional fixing member may be provided for fixing the connecting portion 12*a* and the fixing portion 12*b* after the position adjustment. The additional fixing member may be an integrally threaded component that couples the connecting portion 12*a* and the fixing portion 12*b* together from the outside in the radial direction, for example.

The connector 12 includes the fitting hole 18 and part of the dielectric waveguide body 11*a* is fit into the fitting hole 18. The term "fit" herein means to engage objects whose shapes mate with each other. In FIG. 1, the cross-sectional shape of the fitting hole 18 in the radial direction and the cross-sectional shape of the dielectric waveguide body 11*a* in the radial direction are the same as each other and the sizes thereof are substantially the same as each other. Thus, the dielectric waveguide body 11*a* is in close contact with the inner wall of the fitting hole 18. This restricts the radial movement of the dielectric waveguide end 11*b* and can therefore eliminate the need for adjustment of the radial position of the dielectric waveguide end 11*b* in connection. Further, the radial position of the dielectric waveguide end 11*b* is less likely to move even when the dielectric waveguide 11 is pulled or bent, which can more restrict the return loss.

In an embodiment in which part of the dielectric waveguide body 11*a* is fit into the fitting hole 18, the connector-attached dielectric waveguide preferably satisfies the following relation: $X \geq 8 \times A$, wherein A represents the diameter of the dielectric waveguide body 11*a* and X represents the length of a portion of the dielectric waveguide body 11*a* fit into the fitting hole 18 of the connector 12. Satisfying the above relation enables more restriction of radial movement of the dielectric waveguide end 11*b* and more restriction of the return loss. The upper limit of the length X depends on the length of the fitting hole 18 of the connector 12.

Figure 2:
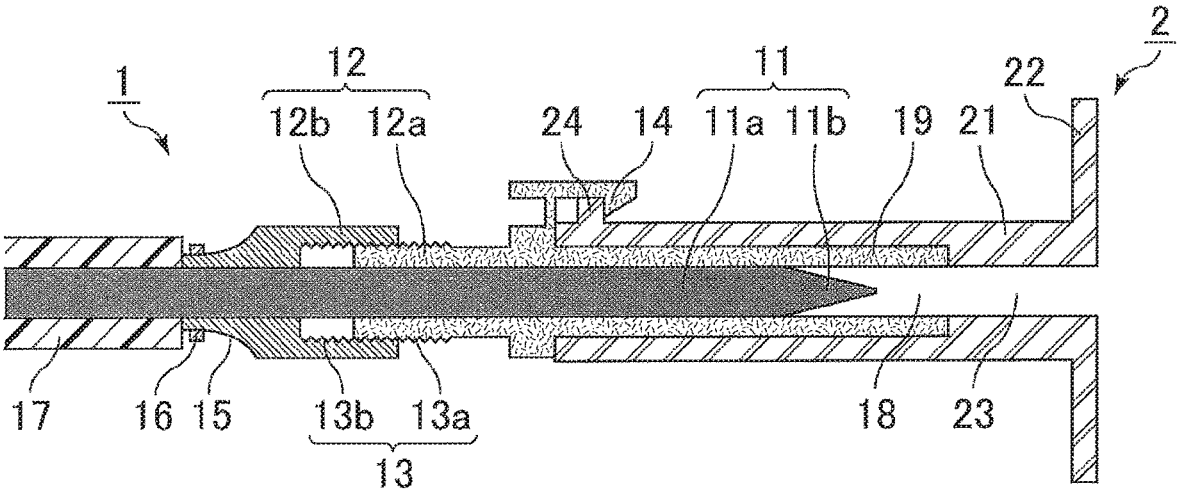
FIG. 2 is a cross-sectional view of an exemplary connection structure of the connector-attached dielectric waveguide of the invention connected with a converter.

With reference to FIG. 2, a connection structure is described in which the connector-attached dielectric waveguide 1 is connected with a converter.

FIG. 2 is a cross-sectional view of an example of the connection structure. The connection structure of FIG. 2 includes the connector-attached dielectric waveguide 1 and a converter 2. The protrusion 19 of the connector-attached dielectric waveguide 1 is inserted into a hollow metallic tube 21 of the converter 2 so that the dielectric waveguide end 11*b* is placed inside the hollow metallic tube. The converter 2 includes a flange 22, and can be connected to a component such as a hollow waveguide (not illustrated) via the flange 22. As illustrated in FIG. 2, providing a locking protrusion 24 to the converter 2 and engaging the locking protrusion 24 with the locking portion 14 of the connector 12 enable easy attachment and detachment of the connector-attached dielectric waveguide 1. Alternatively, the converter may be provided with a locking portion and the connector may be provided with a locking protrusion.

In the connection structure illustrated in FIG. 2, the dielectric waveguide end 11*b* of the dielectric waveguide 11 has a smaller cross-sectional area than the dielectric waveguide body 11*a*. This can reduce a rapid change in impedance between the dielectric waveguide and the hollow metallic tube, leading to a connection structure exhibiting lower transmission and return losses. The presence of the connector 12 enables easy attachment and detachment of the connector-attached dielectric waveguide 1 to the hollow metallic tube 21 of the converter 2.

In the connector 12, the fixing portion 12*b* is axially movably connected with the connecting portion 12*a*. This enables precise adjustment of the axial position of the dielectric waveguide end 11*b* relative to the connecting portion 12*a* by axially moving the connecting portion 12*a* of the connector 12 relative to the fixing portion 12*b* even after the dielectric waveguide 11 is connected with the hollow metallic tube 21. Therefore, the phase can precisely and significantly easily be adjusted.

Part of the dielectric waveguide body 11*s* is fit into the fitting hole 18 of the connector 12 so that radial movement of the dielectric waveguide end 11*b* is restricted. This can eliminate the need for adjustment of the radial position of the dielectric waveguide end 11*b* in connection. Further, the radial position of the dielectric waveguide end 11*b* is less likely to move even when the dielectric waveguide 11 is pulled or bent, which can more restrict the return loss. The connector-attached dielectric waveguide satisfying the relation: $X \geq 8 \times A$ can further more restrict the return loss.

The fitting hole 18 of the connector 12 is configured to have the same diameter as a cavity 23 inside the hollow metallic tube, and they are filled with gas. This gas may be the air. In order to allow the fitting hole 18 of the connector 12 and the cavity 23 inside the hollow metallic tube to have the same diameter, the diameter of the cavity 23 of the hollow metallic tube 21 at a portion into which the protrusion 19 is to be inserted is made greater than that of the other portion by the radial thickness of the protrusion 19.

In the connection structure illustrated in FIG. 2, the connector-attached dielectric waveguide 1 is connected with the converter 2. Instead of the converter 2, the connector-attached dielectric waveguide 1 may be connected with a metal tube having a hollow portion such as a hollow waveguide or a horn antenna.

Figure 3:
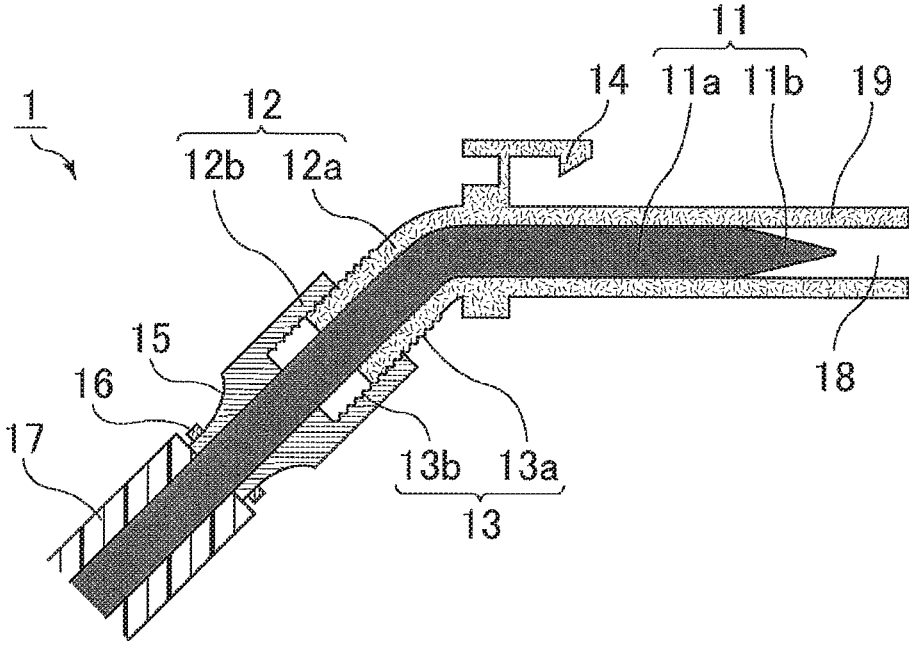
FIG. 3 is a cross-sectional view of another embodiment of the connector-attached dielectric waveguide of the invention.

FIG. 3 illustrates another embodiment of the connector-attached dielectric waveguide 1. As illustrated in FIG. 3, the connecting portion 12*a* may have a curved portion. Even with such a shape, fitting a part of the dielectric waveguide body 11*a* into the fitting hole 18 can restrict radial movement of the dielectric waveguide end 11*b*. This can further more restrict the return loss. In this embodiment, the connector-attached dielectric waveguide also preferably satisfies the relation: $X \geq 8 \times A$.

In the connection structure of FIG. 2, the protrusion 19 of the connector-attached dielectric waveguide 1 is inserted into the hollow metallic tube 21 of the converter 2. Alternatively, the hollow metallic tube 21 may be inserted into the fitting hole 18 of the protrusion 19 or they may be placed such that an end of the protrusion 19 and an end of the hollow metallic tube 21 face each other. In the case where the hollow metallic tube 21 is inserted into the fitting hole 18 of the protrusion 19, an end of the hollow metallic tube 21 is inserted to the position at which the hollow metallic tube 21 is in contact with the dielectric waveguide body 11*a*. The diameter of the fitting hole 18 of the protrusion 19 at a portion into which the hollow metallic tube 21 is to be inserted is made greater than that of the other portion by the radial thickness of the hollow metallic tube 21. Even with such a structure, adjusting the positions of the locking protrusion and the locking portion enables easy connection of the connector-attached dielectric waveguide 1 with the converter 2.

The dielectric waveguide 11 is preferably formed from polytetrafluoroethylene (PTFE), low density PTFE, stretched PTFE, non-fired PTFE, tetrafluoroethylene/hexafluoropropylene copolymerized resin (FEP), foamed FEP, tetrafluoroethylene/perfluoro(alkyl vinyl ether) copolymerized resin (PFA), foamed PFA resin, polyethylene resin, foamed polyethylene resin, polypropylene resin, polystyrene resin, or the like.

The PTFE may be produced from a homo PTFE consisting only of tetrafluoroethylene (TFE), or may be a modified PTFE consisting of TFE and a modifying monomer. The modifying monomer may be any monomer copolymerizable with TFE, and examples thereof include perfluoroolefins such as hexafluoropropylene (HFP); chlorofluoroolefins such as chlorotrifluoroethylene (CTFE); hydrogen-containing olefins such as trifluoroethylene and vinylidene fluoride (VDF); perfluoroalkyl ethylene; and ethylene. One modifying monomer may be used, or a plurality of modifying monomers may be used.

The modified PTFE preferably contains a unit of the modifying monomer in an amount of 3% by mass or less, more preferably 1% by mass or less, still more preferably 0.5% by mass or less of all monomer units. In order to improve the moldability and the transparency, this amount is preferably 0.001% by mass or more. The term "unit of the modifying monomer" herein means a moiety that is part of a molecular structure of the modified PTFE and is derived from the modifying monomer. The term "all monomer units" herein means all moieties derived from any of monomers in the molecular structure of the modified PTFE.

The polytetrafluoroethylene may have a standard specific gravity (SSG) of 2.130 or higher and 2.250 or lower, preferably 2.150 or higher and 2.230 or lower. It may have non melt-processibility, and may have fibrillatability. The standard specific gravity is a value determined by the water replacement method in conformity with ASTM D-792 using a sample prepared in conformity with ASTM D-4895 10.5.

The connector is preferably formed from a material that can easily reduce a rapid change in impedance between the dielectric waveguide 11 and, when the opposite component (not illustrated) is a hollow metallic tube, the hollow metallic tube, and that can easily lead to a connection structure exhibiting low transmission and return losses. Examples of the material include metals such as copper, brass, aluminum, stainless steel, silver, and iron, and resins such as polypropylene, polycarbonate, polyamide, polyether ether ketone, polyphenylene sulfide, acrylonitrile-styrene copolymers, acrylonitrile-butadiene-styrene copolymers, polystyrene, polyoxymethylene acetal, polybutylene terephthalate, polyphenylene ether, polyvinyl chloride, polyethylene, and liquid crystal polymers. One of the metals and the resins may be used alone or a plurality thereof may be used in combination. In particular, the connecting portion 12*a* is preferably formed from any of the metals.

The connector-attached dielectric waveguide 1 is preferably such that the dielectric waveguide 11 includes the dielectric waveguide body 11*a* and the dielectric waveguide end 11*b* having a lower permittivity than the dielectric waveguide body 11*a* and that the dielectric waveguide body 11*a* and the dielectric waveguide end 11*b* are seamlessly and monolithically formed from the same material. This structure enables easy processing and connection even with a small diameter, possibly leading to formation of a connection structure exhibiting much lower transmission and return losses of a high frequency signal.

The connector-attached dielectric waveguide 1 is preferably such that the dielectric waveguide 11 includes the dielectric waveguide body 11*a* and the dielectric waveguide end 11*b* having a lower density than the dielectric waveguide body 11*a* and that the dielectric waveguide body 11*a* and the dielectric waveguide end 11*b* are seamlessly and monolithically formed from the same material. This structure enables easy processing and connection even with a small diameter, possibly leading to formation of a connection structure exhibiting much lower transmission and return losses of a high frequency signal.

The methods of using a special shape as disclosed in Patent Literature documents 1 and 2 have difficulty in processing a narrow dielectric waveguide into such a special shape, and thus cannot be used as methods for transmitting millimeter waves or sub-millimeter waves. Further, improved transmission efficiency is awaited. In the method of inserting a tapered dielectric waveguide and fixing it to a converting portion as disclosed in Patent Literature 1, the dielectric waveguide portion is bent and therefore a stress is applied, so that the tip of the tapered structure is displaced. This causes a change in properties of reflecting high frequency signals at the converting portion, resulting in unstable performance.

Patent Literature 3 also discloses the following. In the method disclosed therein with the use of the dielectric line (line 1) made of a material of a high permittivity, electromagnetic waves are not directly input to/output from the dielectric line (line 1) made of a material of a high permittivity but are input/output via the dielectric line (line 2) made of a material of a low permittivity. This can reduce reflection of electromagnetic waves toward the line 1 and enables easy input/output of electromagnetic waves. Still, unfortunately, this method involves bonding of two dielectric lines of different materials and forming an interface having low reflection is difficult.

In the method disclosed in Non-Patent Literature 1, horn-shaped jigs need to be attached to a dielectric waveguide.

In the case of connecting the connector-attached dielectric waveguide of the invention with a hollow metallic tube for use, the dielectric waveguide including a dielectric waveguide body and a dielectric waveguide end that has a lower permittivity or density than the dielectric waveguide body can reduce a rapid change in impedance between the dielectric waveguide and the hollow metallic tube and enables a connection structure exhibiting low transmission and return losses.

The dielectric waveguide body and the dielectric waveguide end seamlessly and monolithically formed from the same material can eliminate the need for processing to form an interface and can lead to excellent transmission efficiency. Accordingly, a change in impedance at an interface does not occur even when the dielectric waveguide is bent and therefore a stress is applied. Thus, the dielectric waveguide can exhibit stable properties even when bent. In other words, even when the dielectric waveguide body 11*a* and the dielectric waveguide end 11*b* have different permittivities or densities, preferably, the dielectric waveguide body 11*a* and the dielectric waveguide end 11*b* are not formed from different materials joined together but seamlessly formed from the same material. In this case, the dielectric waveguide 11 has no interface as illustrated in FIG. 1.

Letting the length of the dielectric waveguide end 11*b* be L and the diameter of the dielectric waveguide body 11*a* be D, L and D preferably satisfy the following conditions:

when D is smaller than 0.5 mm, L/D=20;

when D is not smaller than 0.5 mm but smaller than 1 mm, L/D=10;

when C is not smaller than 1 mm but smaller than 10 mm, L/D=5 and the maximum L=10 mm; and when D is not smaller than 10 mm, L=10 mm.

The connector-attached dielectric waveguide 1 is preferably such that the dielectric waveguide body 11*a* has a permittivity of 1.80 or higher and 2.30 or lower and the dielectric waveguide end 11*b* has a permittivity of 2.20 or lower. The connector-attached dielectric waveguide 1 is more preferably such that the permittivity of the dielectric waveguide body 11*a* is 2.05 or higher and 2.30 or lower and the permittivity of the dielectric waveguide end 11*b* is 2.20 or lower.

The permittivity of the dielectric waveguide body 11*a* is preferably 1.80 or higher and 2.30 or lower, more preferably 1.90 or higher, still more preferably 2.05 or higher.

In order to achieve high transmission efficiency, the permittivity of the dielectric waveguide end 11*b* is preferably 2.20 or lower, more preferably 2.10 or lower, still more preferably 2.00 or lower.

In order to reduce a rapid change in permittivity, the permittivity of the dielectric waveguide end 11*b* may also preferably decrease gradually or stepwise toward the tip. For the dielectric waveguide end 11*b* having a permittivity that decreases toward the tip, the permittivity of the tip of the dielectric waveguide end 11*b* preferably falls within the above range. The reduction rate in permittivity of the dielectric waveguide end 11*b* toward the tip per 1 mm is preferably 0.005% or higher, more preferably 0.01% or higher, while preferably 20% or lower, more preferably 10% or lower.

The dielectric waveguide end 11*b* may also preferably have a lower density than the dielectric waveguide body 11*a*. Such a difference in density can easily reduce a rapid change in permittivity, can reduce the return loss, and can lead to high transmission efficiency.

Preferably, the dielectric waveguide body 11*a* has a density of 1.90 g/cm$^3$ or higher and 2.40 g/cm$^3$ or lower and the dielectric waveguide end 11*b* has a density that is 90% or less of the density of the dielectric waveguide body 11*a*.

The density of the dielectric waveguide body 11*a* is preferably 1.90 g/cm$^3$ or higher and 2.40 g/cm$^3$ or lower. The density is more preferably 1.95 g/cm$^3$ or higher. The density of the dielectric waveguide body 11*a* is more preferably 2.25 g/cm$^3$ or lower.

Common resin lines are known to have a lower permittivity as the density becomes lower. The density is a value determined by hydrostatic weighing in accordance with JIS Z8807.

In order to achieve nigh transmission efficiency, the density of the dielectric waveguide end 11*b* is preferably as low as possible, and is preferably 90% or less, more preferably 60% or less, still more preferably 40% or less of the density of the dielectric waveguide body 11*a*. In order to achieve good strength of the dielectric waveguide end 11*b*, the density thereof is preferably 10% or more, more preferably 30% or more of the density of the dielectric waveguide body 11*a*.

In order to reduce a rapid change in permittivity, the density of the dielectric waveguide end 11*b* preferably decreases gradually or stepwise toward the tip. For the dielectric waveguide end 11*b* having a density that decreases toward the tip, the density of the tip of the dielectric waveguide end 11*b* preferably falls within the above range. The reduction rate in density of the dielectric waveguide end 11*b* toward the tip per 1 mm is preferably 0.05% or higher, more preferably 0.1% or higher, still more preferably 0.5% or higher. In order to achieve good strength of the dielectric waveguide end 11*b*, the reduction rate in density of the dielectric waveguide end 11*b* toward the tip per 1 mm is preferably 30% or lower, more preferably 20% or lower, still more preferably 10% or lower.

The dielectric waveguide body 11*a* preferably has a hardness of 95 or higher. The hardness is more preferably 97 or higher, still more preferably 98 or higher, particularly preferably 99 or higher. The upper limit thereof may be, but is not limited to, 99.9. The dielectric waveguide body 11*a* having a hardness falling within the above range can have a high permittivity and can easily provide a dielectric waveguide having a low loss tangent. This dielectric waveguide is less likely to be damaged and is less likely to suffer blockage or breakage.

The hardness is determined by the spring hardness standardized in JIS K6253-3.

The hardness greatly contributes to the strength and bending stability of the dielectric waveguide. A higher hardness can lead to a higher strength and can further reduce a change in permittivity in bending and an increase in loss tangent.

The dielectric waveguide body 11*a* preferably has a loss tangent (tan δ) at 2.45 GHz of $1.20\times10^{-4}$ or lower. The loss tangent (tan δ) is more preferably $1.00\times10^{-4}$ or lower, still more preferably $0.95\times10^{-4}$ or lower. The lower limit of the loss tangent (tan δ) may be, but is not limited to, $0.10\times10^{-4}$ or $0.80\times10^{-4}$.

The loss tangent is determined at 2.45 GHz using a cavity resonator available from Kanto Electronic Application and Development Inc. The lower the loss tangent is, the better the transmission efficiency of the dielectric waveguide is.

The dielectric waveguide 11 may have a rectangular shape, a circular shape, or an elliptical shape. Still, it more preferably has a circular shape because a circular dielectric waveguide can more easily be produced than rectangular one.

Preferably, the dielectric waveguide end 11*b* has a lower permittivity than the dielectric waveguide body 11*a*, and the gas inside the fitting hole 18 has a lower permittivity than the dielectric waveguide end 11*b*. In other words, the dielectric waveguide end 11*b* having permittivity lower than that of the dielectric waveguide body 11*a* and higher than that of the gas can reduce a rapid change in permittivity, reduce the return loss and lead to high transmission efficiency.

The dielectric waveguide end 11*b* may also preferably have a lower density than the dielectric waveguide body 11*a*.

Common resin lines are known to have a lower permittivity as the density becomes lower. In the invention, the density of the dielectric waveguide end 11*b* is lower than the density of the dielectric waveguide body 11*a*, so that the dielectric waveguide end 11*b* has a reduced permittivity and the return loss at the interface between the fitting hole 18 and the gas is reduced. The density is a value determined by hydrostatic weighing in accordance with JIS Z8807.

The dielectric waveguide 11 and the fitting hole 18 each may have either a rectangular cross-sectional shape, a circular cross-sectional shape, or an elliptical cross-sectional shape. Still, for the above reasons, they preferably have the same shape. Each of them more preferably has a circular cross-sectional shape because a circular dielectric waveguide can more easily be produced than rectangular one.

The dielectric waveguide body 11*a* preferably has a length of 1 mm or longer and 199 mm or shorter. In order to achieve downsizing and to reduce a rapid change in permittivity, the dielectric waveguide end 11*b* preferably has a length of 1 mm or longer and 50 mm or shorter.

The dielectric waveguide body 11*a* usually has a diameter of about 6 mm for 30 GHz and about 3 mm for 60 GHz, although it is in accordance with the permittivity of the body.

The outer layer 17 may be formed from the same PTFE as for the dielectric waveguide 11. The outer layer 17 may be formed from a hydrocarbon resin such as polyethylene, polypropylene, or polystyrene, or may be formed from any of these resins in a foamed state.

The outer layer 17 may have an inner diameter of 0.1 mm or greater and 150 mm or smaller, preferably 0.6 mm or greater and 10 mm or smaller. The outer layer 17 may have an outer diameter of 0.5 mm or greater and 200 mm or smaller, preferably 1 mm or greater and 150 mm or smaller.

The following describes a method of forming the dielectric waveguide 11 from polytetrafluoroethylene (PTFE). The dielectric waveguide 11 may be obtainable by stretching an end of a resin line in the longitudinal direction.

The resin line may be obtainable by molding PTFE by a known molding method. Specifically, a PTFE line may be obtainable by mixing PTFE powder with an extrusion aid, molding the mixture into a pre-molded article using a pre-molding machine, and then paste extrusion molding the pre-molded article.

The paste extrusion molding may be performed without pre-molding. Specifically, a PTFE line may be obtainable by mixing PTFE powder with an extrusion aid, directly putting the mixture into a cylinder of a paste extruder, and then paste extrusion molding the mixture.

Then, an end of the resulting resin line is stretched in the longitudinal direction. This stretching can provide a dielectric waveguide 11 whose dielectric waveguide end 11*b* has a smaller cross-sectional area than the dielectric waveguide body 11*a*. In this process, heating only a portion to be stretched facilitates production of a desired dielectric waveguide end 11*b*. The stretch ratio may be 1.2 times or higher and 5 times or lower.

The method of stretching an end of a resin line in the longitudinal direction can also provide the dielectric waveguide 11 whose dielectric waveguide end 11*b* has a lower permittivity or density than the dielectric waveguide body 11*a*.

The stretching may be performed by holding an end of a resin line with a tool such as pliers and stretching the resin line in the longitudinal direction. If the held portion is not stretched, this portion may be cut off. This can easily provide a truncated-cone-shaped dielectric waveguide end having a permittivity or a density that gradually or stepwise decreases toward the tip and having a cross-sectional area that gradually or stepwise decreases toward the tip.

The dielectric waveguide 11 can preferably be produced by a five or six step method including a step (2) of providing a resin line formed from polytetrafluoroethylene, a step (4) of heating an end of the resin line, and a step (5) of stretching the heated end in the longitudinal direction to provide a dielectric waveguide.

The respective steps are described hereinbelow.

The production method preferably further includes a step (1) of mixing polytetrafluoroethylene (PTFE) powder with an extrusion aid to provide a pre-molded article of PTFE before the step (2).

The PTFE powder may be produced from a home PTFE consisting only of tetrafluoroethylene (TFE), a modified PTFE consisting of TFE and a modifying monomer, or a mixture thereof. The modifying monomer may be any monomer copolymerizable with TFE, and examples thereof include perfluoroolefins such as hexafluoropropylene (HFP); chlorofluoroolefins such as chlorotrifluoroethylene (CTFE); hydrogen-containing olefins such as trifluoroethylene and vinylidene fluoride (VDF); perfluoroalkyl ethylene; and ethylene. One modifying monomer may be used, or a plurality of modifying monomers may be used.

The modified PTFE preferably contains a unit of the modifying monomer in an amount of 3% by mass or less, more preferably 1% by mass or less, still more preferably 0.5% by mass or less of all monomer units. In order to improve the moldability and the transparency, this amount is preferably 0.001% by mass or more.

The PTFE may have a standard specific gravity (SSG) of 2.130 or higher and 2.250 or lower, preferably 2.150 or higher and 2.230 or lower. The PTFE may have non melt-processibility, and may have fibrillatability. The standard specific gravity is a value determined by the water replacement method in conformity with ASTM D-792 using a sample prepared in conformity with ASTM D-4895 10.5.

The PTFE powder mixed with an extrusion aid may be aged at room temperature for about 12 hours to provide extrusion aid-mixed powder. This powder may be put into a pre-molding machine and pre-molded at 1 MPa or higher and 10 MPa or lower, more preferably 1 MPa or higher and 5 MPa or lower, for 1 minute or longer and 120 minutes or shorter. This can provide a pre-molded article of PTFE.

The extrusion aid may be hydrocarbon oil, for example.

The amount of the extrusion aid is preferably 10 parts by mass or more and 40 parts by mass or less, more preferably 15 parts by mass or more and 30 parts by mass or less, relative to 100 parts by mass of the PTFE powder.

Step (2)

This step is a step of providing a resin line formed from PTFE.

In the case where the step (1) is performed to provide a pre-molded article of PTFE, this pre-molded article may be extruded using a paste extruder to provide a resin line in the step (2).

In the case where no pre-molded article of PTFE is prepared before the step (2), PTFE powder may be mixed with an extrusion aid, the mixture may directly be put into a cylinder of a paste extruder, and the mixture may be paste extrusion molded to provide a resin line.

For the resin line containing an extrusion aid, the resin line is preferably heated at 80° C. or higher and 250° C. or lower for 0.1 hours or longer and 6 hours or shorter to evaporate the extrusion aid.

The cross-sectional shape of the resin line may be a rectangular shape, a circular shape, or an elliptical shape. Still, it is preferably a circular shape because a circular resin line can more easily be produced than rectangular one. The resin line may have a diameter of 0.1 mm or greater and 150 mm or smaller, preferably 0.6 mm or greater and 9 mm or smaller.

The production method of the invention may include a step (3) of heating the resin line obtained in the step (2).

Specific heating conditions are changed as appropriate in accordance with the cross-sectional shape and size of the resin line. For example, the resin line is preferably heated at 326° C. to 345° C. for 10 seconds to 2 hours. The heating temperature is more preferably 330° C. or higher and 380° C. or lower. The heating duration is more preferably one hour or longer and three hours or shorter.

Heating at the above temperature for a predetermined duration causes the air contained in the resin line to be released outside of the resin line. This seems to enable a dielectric waveguide having a high permittivity. Further, the resin line is not completely fired. This seems to enable a dielectric waveguide having a low loss tangent. Further, heating at the above temperature for a predetermined duration can advantageously improve the hardness of the resin line and increase the strength thereof.

The heating may be performed using a salt bath, a sand bath, a hot air circulating electric furnace, or the like. In order to easily control the heating conditions, the heating is preferably performed using a salt bath. This can also advantageously shorten the heating time within the above range. The heating with a salt bath may be performed using a device for producing a coated cable disclosed in JP 2002-157930 A, for example.

Step (4)

This is a step of heating an end of the resin line obtained in the step (2). This step may be a step of heating an end of the resin line obtained in the step (3).

In the step (4), an end of the resin line is heated, so that a desired dielectric waveguide end can easily be produced.

In the step (4), although not limited, a portion to be heated is preferably apart from a tip of the resin line by 0.8 mm or more and 150 mm or less, more preferably a portion to be heated is apart therefrom by 20 mm or less.

The heating temperature in the step (4) is preferably 100° C. or higher, more preferably 200° C. or higher, still more preferably 250° C. or higher. The heating temperature in the step (4) is preferably 450° C. or lower, more preferably 400° C. or lower, still more preferably 380° C. or lower.

Step (5)

This step is a step of stretching the heated end obtained in the step (4) in the longitudinal direction to provide a dielectric waveguide.

The stretching may be performed by holding the heated end obtained in the step (4) with a tool such as pliers and stretching the resin line in the longitudinal direction. If the held portion is not stretched, this portion may be cut off. This can easily provide a truncated-cone-shaped dielectric waveguide end having a permittivity or a density that gradually or stepwise decreases toward the tip and having a cross-sectional area that gradually or stepwise decreases toward the tip.

The stretch ratio is preferably 1.2 times or more, more preferably 1.5 times or more. The stretch ratio is preferably 10 times or less, more preferably 5 times or less.

The stretching speed is preferably 1%/sec or higher, more preferably 10%/sec or higher, still more preferably 20%/sec or higher. The stretching speed is preferably 1000%/sec or lower, more preferably 800%/sec or lower, still more preferably 500%/sec or lower.

The production method of the invention may include a step (6) of inserting the dielectric waveguide obtained in the step (5) into an outer layer.

The outer layer formed from PTFE may be produced by the following method, for example.

PTFE powder may be mixed with an extrusion aid and may be aged at room temperature for 1 hour or longer and 24 hours or shorter. The resulting extrusion aid-mixed powder may be put into a pre-molding machine and pressurized at 1 MPa or higher and 10 MPa or lower for about 30 minutes. Therefore, a cylindrical pre-molded article of PTFE may be obtained. The pre-molded article of PTFE may be extrusion molded using a paste extruder. Therefore, a hollow cylindrical molded article may be obtained. When this molded article contains an extrusion aid, this molded article is preferably heated at 80° C. or higher and 250° C. or lower for 0.1 hours or longer and 6 hours or shorter so that the extrusion aid is evaporated. This molded article may be stretched at 250° C. or higher and 320° C. or lower, more preferably 280° C. or higher and 300° C. or lower and at a stretch ratio of 1.2 times or more and 5 times or less, more preferably 1.5 times or more and 3 times or less. Therefore, a hollow cylindrical outer layer may be obtained.

Even for a dielectric waveguide formed from a resin such as polyethylene resin, polypropylene resin, or polystyrene resin, stretching of an end of a resin line in the longitudinal direction can easily provide a dielectric waveguide whose dielectric waveguide end has a smaller cross-sectional area than the dielectric waveguide body.

EXAMPLES

The invention is described with reference to a production example and reference examples. These production and reference examples are not intended to limit the invention.

Production Example 1

Resin Line

PTFE fine powder (SSG: 2.175) in an amount of 100 parts by mass was mixed with 20.5 parts by mass of ISOPAR G™ available from Exxon Mobil Corp. serving as an extrusion aid, and the mixture was aged at room temperature for 12 hours. Therefore, extrusion aid-mixed powder was obtained. This extrusion aid-mixed powder was put into a pre-molding machine and pressurized at 3 MPa for 30 minutes. Therefore, a cylindrical pre-molded article was obtained.

This pre-molded article was paste-extruded using a paste extruder, and then heated at 200° C. for one hour so that the extrusion aid was evaporated. Therefore, a resin line having a diameter of 3.3 mm was obtained.

This resin line was cut so as to have a total length of 660 mm.

(Dielectric waveguide)

The resin line obtained was heated at 330° C. for 70 minutes. A portion (end) 20 mm or less apart from a tip of the resin line was heated at 260° C. A portion 5 mm or less apart from the tip was then held and the end was stretched at a stretch ratio of two times and at a stretching speed of 200%/sec in the longitudinal direction. Therefore, the end was stretched to 40 mm. After the stretching, a portion 10 mm or less apart from the tip held in the stretching was cut off. Therefore, a dielectric waveguide 11 was obtained. The stretching reduced the diameter of the dielectric waveguide end 11*b* toward the tip thereof along the longitudinal direction. The dielectric waveguide end 11*b* had a length of 10 mm in the longitudinal direction.

(Outer layer)

PTFE fine powder was mixed with ISOPAR G™ available from Exxon Mobil Corp. serving as an extrusion aid, and the mixture was aged at room temperature for 12 hours. Therefore, extrusion aid-mixed powder was obtained. This extrusion aid-mixed powder was put into a pre-molding machine and pressurized at 3 MPa for 30 minutes. Therefore, a cylindrical pre-molded article was obtained.

This pre-molded article was paste-extruded using a paste extruder, and then heated at 200° C. for one hour so that the extrusion aid was evaporated. Therefore, a molded article having an outer diameter of 10 mm and an inner diameter of 3.6 mm was obtained. This molded article was stretched at a ratio of two times at 300° C. Therefore, an outer layer 17 having an outer diameter of 9.5 mm and an inner diameter of 3.6 mm was obtained.

The dielectric waveguide 11 was inserted into the outer layer 17. Therefore, a dielectric waveguide 11 including an outer layer 17 was obtained.

Connector

The dielectric waveguide 11 obtained in Production Example 1 was attached to the connector 12, whereby the connector-attached dielectric waveguide 1 was obtained.

The outer layer 17 at a portion where the connector 12 is to be attached was removed from the dielectric waveguide 11 in advance.

Reference Example 1

The connector 12 includes the fitting hole 18 and the dielectric waveguide body 11*a* is fit thereinto. The length X (FIG. 1) of the portion of the dielectric waveguide body 11*a* fit into the fitting hole 18 of the connector 12 (from the end of the dielectric waveguide 11*a* on the dielectric waveguide end 11*b* side to the position where the fixing portion 12*b* of the connector 12 and the outer layer 17 are in contact with each other) was set to 26.4 mm, i.e., eight times the diameter of the dielectric waveguide body 11*a*. A force of 0.1 N was applied from the connector 12 to the dielectric waveguide 11 in the direction of the outer layer 17 at a position 100 mm apart from the end of the dielectric waveguide body 11*a* on the side of the fixing portion 12*b* of the connector 12 toward the outer layer 17. The dielectric waveguide body 11*a* was bent 45 degrees from the longitudinal axis at the contact position between the outer layer 17 of the dielectric waveguide body 11*a* and the connector 12, and the reflection performance before and after the bending was compared. The return loss values within the range of 75 to 90 GHz were measured using a network analyzer (8510C available from Hewlett-Packard Co.). The results were as follows.

Before bending: −15.5 dB

After bending: −15.5 dB

The position of the tip of the dielectric waveguide end 11*b* was not changed before and after the bending.

Reference Example 2

The return loss values were compared as in Reference Example 1, except that the length X of the portion of the dielectric waveguide body 11*a* fit into the fitting hole 18 of the connector 12 was set to 16.5, i.e., five times the diameter of the dielectric waveguide body 11*a*. The return loss after the bending was greater than that in Reference Example 1.

Before bending: −15.5 dB

After bending: −9.3 dB

The position of the tip of the dielectric waveguide end 11*b* was moved 0.5 mm after the bending.

REFERENCE SIGNS LIST

1: connector-attached dielectric waveguide
11: dielectric waveguide
11*a*: dielectric waveguide body
11*b*: dielectric waveguide end
12: connector
12*a*: connecting portion
12*b*: fixing portion
13: phase adjustment threaded fastener
13*a*: external thread
13*b*: internal thread
14: locking portion
15: tapered surface
16: clamp
17: outer layer
18: fitting hole
19: protrusion
2: converter
21: hollow metallic tube
22: flange
23: cavity inside hollow metallic Lube
24: locking protrusion

The invention claimed is:

1. A connector-attached dielectric waveguide comprising a dielectric waveguide and a connector, the dielectric waveguide including a dielectric waveguide body and a dielectric waveguide end, the dielectric waveguide end having a smaller cross-sectional area than the dielectric waveguide body, the connector comprising:

a connecting portion that slidably holds the dielectric waveguide body; and a fixing portion that is axially movably connected with the connecting portion and that is fixed to the dielectric waveguide body.

2. The connector-attached dielectric waveguide according to claim 1, wherein the connector further comprises a phase adjustment threaded fastener configured as the fixing portion that is axially movably connected with the connecting portion.

3. The connector-attached dielectric waveguide according to claim 1, wherein the connector comprises a fitting hole, at least a part of an outer circumferential surface of the dielectric waveguide body is in fitting contact with an inner circumferential surface of the fitting hole.

4. The connector-attached dielectric waveguide according to claim 3, wherein the connector-attached dielectric waveguide satisfies the following relation:

$$X \geq 8 \times A$$

wherein A represents a diameter of the circumferential surface of the dielectric waveguide body that is in fitting contact with the inner circumferential surface of the fitting hole and X represents a length of a portion of the dielectric waveguide body in fitting contact with fit into the fitting hole of the connector.

* * * * *